US007706724B2

(12) United States Patent
Kawakami et al.

(10) Patent No.: US 7,706,724 B2
(45) Date of Patent: Apr. 27, 2010

(54) CHARGING-ROLLER BEARING MEMBER, PROCESS CARTRIDGE, AND IMAGE FORMING APPARATUS

(75) Inventors: Yoshihiro Kawakami, Hyogo (JP); Koji Kato, Osaka (JP); Hirobumi Ooyoshi, Osaka (JP); Tomofumi Yoshida, Osaka (JP); Kenzo Tatsumi, Osaka (JP); Yoshiyuki Shimizu, Osaka (JP); Tomohiro Kubota, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 11/768,607

(22) Filed: Jun. 26, 2007

(65) Prior Publication Data

US 2008/0019720 A1 Jan. 24, 2008

(30) Foreign Application Priority Data

Jul. 21, 2006 (JP) ..... 2006-199232

(51) Int. Cl.
*G03G 15/02* (2006.01)

(52) U.S. Cl. ..... 399/174; 399/176

(58) Field of Classification Search ..... 399/90, 399/174, 176; 361/221, 222, 225
See application file for complete search history.

(56) References Cited

U.S. PATENT DOCUMENTS 5,532,795 A 7/1996 Tatsumi et al.
5,815,767 A 9/1998 Kutsuwada et al.
6,085,062 A 7/2000 Mizuishi et al.
6,128,449 A 10/2000 Zenba et al.
6,144,819 A * 11/2000 Nishiuwatoko ..... 399/90
2002/0114644 A1* 8/2002 Stickler ..... 399/176
2006/0024080 A1* 2/2006 Chadani et al. ..... 399/90
2008/0199234 A1 8/2008 Hagi et al.

FOREIGN PATENT DOCUMENTS

JP 2002-214885 7/2002

OTHER PUBLICATIONS

U.S. Appl. No. 11/951,584, filed Dec. 6, 2007, Yoshida, et al.
U.S. Appl. No. 11/949,339, filed Dec. 3, 2007, Tatsumi, et al.
U.S. Appl. No. 11/967,635, filed Dec. 31, 2007, Shimizu, et al.
U.S. Appl. No. 12/020,915, filed Jan. 28, 2008, Kubota, et al.

(Continued)

*Primary Examiner*—David M Gray
*Assistant Examiner*—Barnabas T Fekete
(74) *Attorney, Agent, or Firm*—Oblon, Spivak, McClelland, Maier & Neustadt, L.L.P.

(57) ABSTRACT

A first bearing member and a second bearing member fit in a first side and a second side of a rotating shaft in the axial direction, respectively. The first bearing member is held by a supporting portion provided in a casing on a side corresponding to an emplacing member of an image carrier drum. The second bearing member is held by fitting in a fit-in portion from inside. A wall surface that regulates a charging roller in a longitudinal direction is formed on the second bearing member to protrude from a wall surface rotatably and pivotally supporting the charging roller.

14 Claims, 8 Drawing Sheets

OTHER PUBLICATIONS

U.S. Appl. No. 12/042,850, filed Mar. 5, 2008, Shimizu, et al.
U.S. Appl. No. 12/103,941, filed Apr. 16, 2008, Shimizu.
U.S. Appl. No. 12/170,842, filed Jul. 10, 2008, Kubota, et al.
U.S. Appl. No. 12/257,547, filed Oct. 24, 2008, Kubota, et al.

* cited by examiner

CHARGING-ROLLER BEARING MEMBER, PROCESS CARTRIDGE, AND IMAGE FORMING APPARATUS

CROSS-REFERENCE TO RELATED APPLICATIONS

The present document incorporates by reference the entire contents of Japanese priority document, 2006-199232 filed in Japan on Jul. 21, 2006.

BACKGROUND OF THE INVENTION

1. Field of the Invention

The present invention relates to a charging-roller bearing member, process cartridge, and image forming apparatus for use in an image forming apparatus to be used as electrophotography-applied output recording equipment, such as a copier, printer, or facsimile.

2. Description of the Related Art

In an image forming apparatus, such as a copier, printer, facsimile machine, or printing machine, a process cartridge may be used having accommodated therein at least one of a charging unit, a developing unit, and a cleaning unit among a latent image carrier and devices for an image forming process. Such a process cartridge is removably provided to an image forming apparatus body. By taking the process cartridge outside of the apparatus at the time of replacement and maintenance inspection, the work in a narrow space within the apparatus is reduced. Also, such a configuration of the process cartridge has been known in which, for example, a photosensitive drum, which is a drum-shaped latent image carrier, is rotatably supported in a casing forming the cartridge and a charging roller that performs a charging process onto this photosensitive drum is mounted inside the casing.

Japanese Patent Application Laid-Open No. 2002-214885 (hereinafter, "first patent document") discloses a configuration, as a supporting configuration for the charging roller, in which both ends of a rotating shaft of the charging roller in an axial direction are supported via a bearing by both side walls of the casing of the cartridge.

However, as disclosed in the first patent document, when both of the photosensitive drum and the charging unit that performs a charging process, which is an image forming process onto the photosensitive drum, are incorporated in the casing forming the process cartridge, the following problems may occur depending on the supporting configuration of the photosensitive drum.

When the photosensitive drum is used to form not only a single image but also a multi-color image, such as a full-color image, optimization of a starting position for writing an electrostatic latent image of each photosensitive drum forming each color image is critical in preventing an image color shift and density unevenness.

To achieve this, in a configuration for matching write starting positions of the photosensitive drums in a main scanning direction, positional regulation may be performed in an axial direction in parallel with the main scanning direction of the photosensitive drum.

In an example of the configuration, a flange is disposed between a inner side wall of the cartridge and an end face of the photosensitive drum on one side in an axial direction of the photosensitive drum accommodated in the process cartridge, thereby regulating the position in an axial direction, that is, a so-called thrust direction. Also, a gear is formed on an outer perimeter surface of the flange for shared use as a driving-force transmitting unit.

The charging roller is configured in a manner such that both ends in an axial direction are supported with reference to the same center in the axial direction as the center in the axial direction of the photosensitive drum. Thus, in a supporting configuration for the photosensitive drum and the charging roller incorporated in the process cartridge, in the case of the photosensitive drum, for example, both ends thereof in an axial direction are supported by side walls of the casing of the process cartridge so that the length in an axial direction is longer than that of the charging roller with provision of the gear-added flange. On the other hand, since the charging roller has a length in an axial direction enough to cover the length of an image forming area on the photosensitive drum, the charging roller is located in a range shorter than the axial length of the photosensitive drum. For this reason, both ends of the charging roller in an axial direction are supported not by the side walls of the casing but by, for example, supporting brackets newly provided between the side walls of the casing.

In such a supporting configuration for the charging roller, a space on a side where the gear-added flange on a photosensitive drum side is not present is present as a waste portion. Accordingly, with such a superfluous space in an axial direction of the charging roller occupying the inside of the process cartridge, the process cartridge may be disadvantageously upsized. Moreover, the supporting brackets for supporting both ends of the charging roller in an axial direction are provided between the walls inside the casing, thereby not only upsizing the configuration but also degrading workability because an operation of assembling the charging roller is performed within the inner side walls of the casing, which is a limited narrow space. In particular, since the charging roller is a power-supply member, it is important to ensure a power-supply path. However, in the case of a configuration with wiring between the side walls of the casing, not only a wiring operation but also maintenance workability tends to deteriorate.

SUMMARY OF THE INVENTION

It is an object of the present invention to at least partially solve the problems in the conventional technology.

A charging-roller bearing member according to one aspect of the present invention is for an image forming apparatus including an image carrier drum rotatably supported in such a manner that a perimeter surface is rotatable and a charging unit that uniformly charges the perimeter surface of the image carrier drum in a same casing. The charging unit is a charging roller. The charging-roller bearing member is arranged in opposite to each other along a rotating direction of the perimeter surface of the image carrier drum, the charging-roller bearing member including a first bearing member fitting in a first side of a rotating shaft in an axial direction and a second bearing member fitting in a second side of the rotating shaft in the axial direction. The first bearing member is held by a supporting portion provided in the casing on a side corresponding to an emplacing member of the image carrier drum. The second bearing member is held by fitting in a fit-in portion from inside, the fit-in portion being formed on a side wall of the casing on a side in a longitudinal direction of the image carrier drum where the emplacing member is not positioned. A first wall surface that regulates the charging roller in a longitudinal direction is formed on the second bearing member in a protruding manner from a second wall surface rotatably and pivotally supporting the charging roller.

A process cartridge according to another aspect of the present invention includes a charging-roller bearing member. The charging-roller bearing member is for an image forming apparatus including an image carrier drum rotatably supported in such a manner that a perimeter surface is rotatable and a charging unit that uniformly charges the perimeter surface of the image carrier drum in a same casing. The charging unit is a charging roller. The charging-roller bearing member is arranged in opposite to each other along a rotating direction of the perimeter surface of the image carrier drum, the charging-roller bearing member including a first bearing member fitting in a first side of a rotating shaft in an axial direction and a second bearing member fitting in a second side of the rotating shaft in the axial direction. The first bearing member is held by a supporting portion provided in the casing on a side corresponding to an emplacing member of the image carrier drum. The second bearing member is held by fitting in a fit-in portion from inside, the fit-in portion being formed on a side wall of the casing on a side in a longitudinal direction of the image carrier drum where the emplacing member is not positioned. A first wall surface that regulates the charging roller in a longitudinal direction is formed on the second bearing member in a protruding manner from a second wall surface rotatably and pivotally supporting the charging roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments for achieving the present invention are explained in detail below with reference to the accompanying drawings. It is easy for a person having ordinary skill in the art to change and modify the present invention within the scope of the claims for patent to achieve another embodiment, and these change and modification are included within the scope of the claims for patent. The following merely explains exemplary embodiments of the present invention, and is not meant to restrict the scope of the claims for patent.

Figure 1:
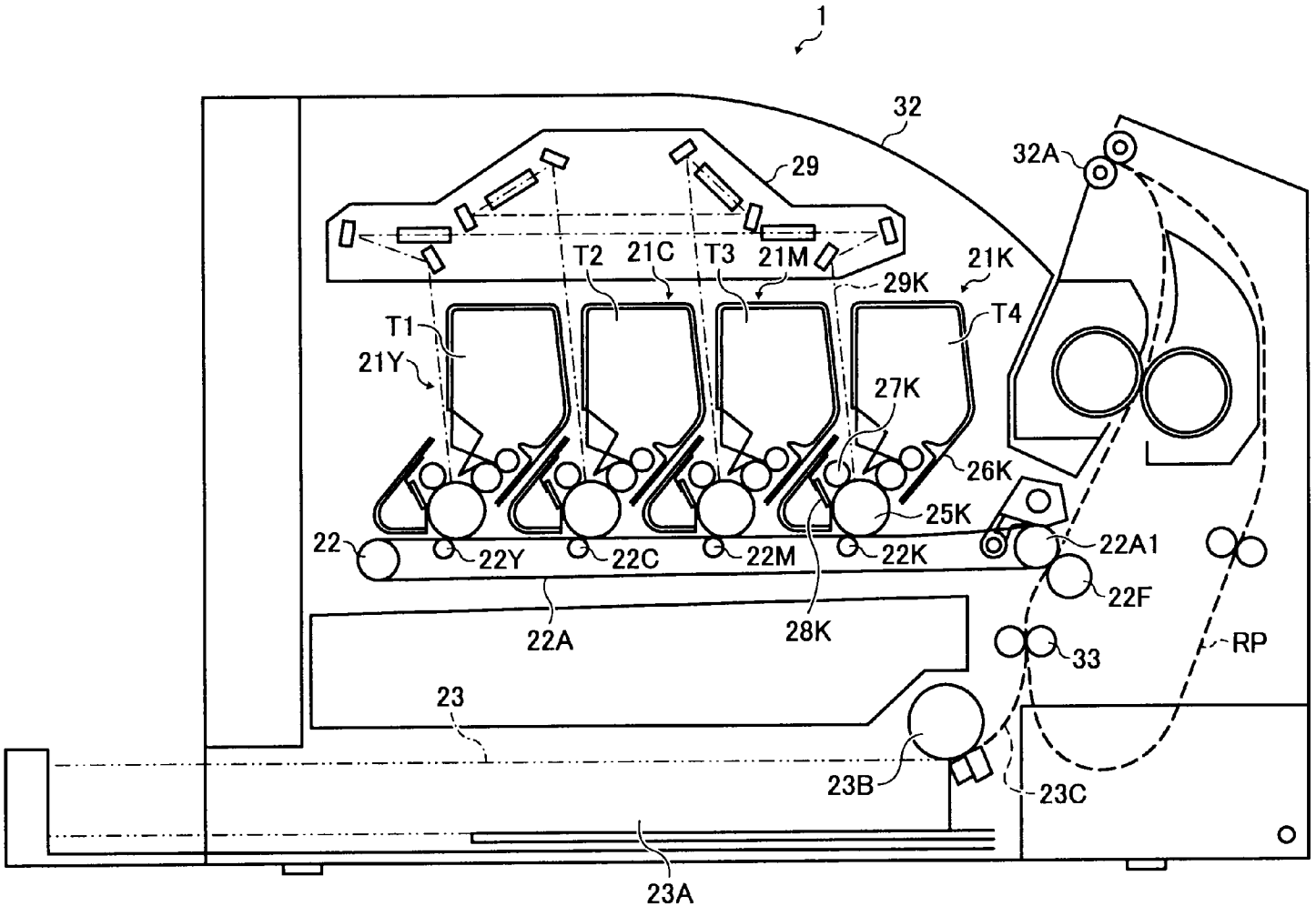
FIG. 1 is a schematic drawing of one example of an image forming apparatus in which a process cartridge according to an embodiment of the present invention is used.

FIG. 1 is a schematic drawing of one example of an image forming apparatus in which a process cartridge according to an embodiment of the present invention is used. The image forming apparatus shown in the drawing is a tandem-adopted color printer capable of forming a full-color image. Here, in the present invention, the image forming apparatus is not meant to be restricted to a printer, but may be a copier, facsimile machine, or printing machine, for example.

As shown in FIG. 1, an image forming apparatus 1 includes image forming units 21Y, 21C, 21M, and 21K that each form an image of each color according to a document image, a transfer unit 22 disposed to face the image forming units 21Y, 21C, 21M, and 21K, a paper feeding cassette 23A included in a paper feeding unit 23 as a sheet supplying unit that supplies a recording sheet to a transfer area where the image forming units 21Y, 21C, 21M, and 21K and the transfer unit 22 face each other, resist rollers 33 that supply the recording sheet conveyed from the paper feeding cassette 23A according to image-formation timing of the image forming units 21Y, 21C, 21M, and 21K, and a fixing unit 10 that performs fixing in a transfer area for the sheet-like medium after transfer. In FIG. 1, a reference numeral 23B denotes a let-out roller, and a reference numeral 23C denotes an anti-redundant-feeding device using a friction separation scheme. Also, although not depicted, a manual paper feeding mechanism can be additionally provided.

In the fixing unit 10, although not shown in detail, a heat-roller fixing scheme is used in which heat rollers and pressure rollers that can face and abut each other across a recording-sheet conveyance path are used to fix an image onto the recording sheet by the action of heat and pressure through processes of fusing, softening and penetration.

In the transfer unit 22, a transfer belt 22A wound around a plurality of rollers as a transfer member is used. Also, transfer bias units 22Y, 22C, 22M, and 22K that apply a transfer bias are disposed at positions facing the photosensitive drums in the respective image forming units. In the transfer unit 22, toner images formed by the respective image forming units by acting a transfer bias having a polarity reverse to that of the toner are sequentially superposed and transferred.

In the transfer unit 22, a secondary transfer bias unit 22F for collectively transferring the toner images superposed and transferred on the transfer belt 22A onto the recording sheet is disposed on a recording-sheet conveyance path.

In FIG. 1, the image forming units 21Y, 21C, 21M, and 21K perform development of colors of yellow, cyan, magenta, and black, respectively. Although using different colors of toner, these image forming units have a similar configuration. Therefore, the configuration of the image forming unit 21K is explained below as a representative example of the configuration of each of the image forming units 21Y, 21C, 21M, and 21K.

The image forming unit 21K includes a photosensitive drum 25K as an electrostatic-latent-image carrier, and a charging unit 27K, a developing unit 26K, and a cleaning unit 28K sequentially disposed along a rotating direction of the photosensitive drum 25K. Between the charging unit 27K and the developing unit 26K, an electrostatic latent image is formed according to image information corresponding to color-separated color with the use of writing light 29K from a writing unit 29. As an electrostatic-latent-image carrier, a belt-shaped carrier may be used instead of a drum-shaped carrier. Among devices for image formation disposed around the photosensitive drum 25K, at least a charging roller for use in the photosensitive drum 25K and the charging unit 27K is explained with reference to FIG. 2, and is accommodated in a process cartridge 100 provided with a casing.

In the image forming apparatus with the configuration as explained above, once the photosensitive drum 25K is driven for rotation by a main motor not shown at the time of image formation and uniformly charged by the charging unit 27K, a writing process is performed.

The image to be written is written by the writing unit 29 according to digital image information from a controller unit not shown so as to form an electrostatic latent image.

The electrostatic latent image formed on the photosensitive drum 25K is visualized by the developing unit 26K using toner of a color having a complementary-color relation with a color-separation color. In a developing process, for example, a direct-current (DC) voltage with an alternating-current (AC) bias superposed thereon is applied to a developing sleeve. With this, toner is attached for development only to an image portion where the potential is decreased due to radiation of writing light, thereby forming a toner image.

Toner images of the respective colors obtained through visualization of the developing process are transferred onto the recording sheet let out by the resist rollers 33 at resist timing set thereby. Here, it is assumed in the present embodiment that the developing unit for use in the developing process in FIG. 1 has a configuration in which toner-supply tanks (denoted by T1 to T4) are additionally provided.

The transfer belt 22A has the toner images electrostatically transferred from the photosensitive drums with application of a bias having a polarity reverse to that of the toner by the transfer bias units 22Y, 22C, 22M, and 22K provided to the transfer unit 22 at positions facing the photosensitive drums of the respective image forming units. The superposed and transferred toner images are then collectively transferred onto the recording sheet by the secondary transfer bias unit 22F.

The recording sheet after the transferring process for each color is self-stripped from the transfer belt 22A at a driving-side roller (for convenience, denoted by a reference numeral 22A1 in FIG. 1) of the transfer belt unit, and then conveyed toward the fixing unit 10. In the fixing unit 10, the toner images are fixed when the recording sheet passes through a fixing nip formed between rollers, and the recording sheet is then delivered to a paper-delivery tray 32 via paper-delivery rollers 32A capable rotating in a forward and backward direction. The paper-delivery rollers 32A are used as a switch-back conveying member at the time of both-side image formation, which will be explained below.

That is, the image forming apparatus 1 shown in FIG. 1 can perform not only image formation on one side of the recording sheet delivered after fixing but also image formation on both sides thereof. Thus, at the time of both-side image formation, the recording sheet after fixing once moved by the paper-delivery rollers 32A to the paper-delivery tray 32 side, and then the paper-delivery rollers 32A are rotated in reverse in a state of nipping the rear end of the recording sheet in a moving direction. With this, the recording sheet is conveyed from the paper-delivery tray 32 side to a reverse circulation path RP, thereby being let out toward the resist rollers 33 positioned at a meeting portion between the circulation path and a roller-running path from the paper feeding cassette 23A. Switching of the conveyance path of the recording sheet between one-side and both-side image formation is achieved by a conveyance-path switching nail (not shown) disposed at the rear of the fixing unit 10.

Figure 2:
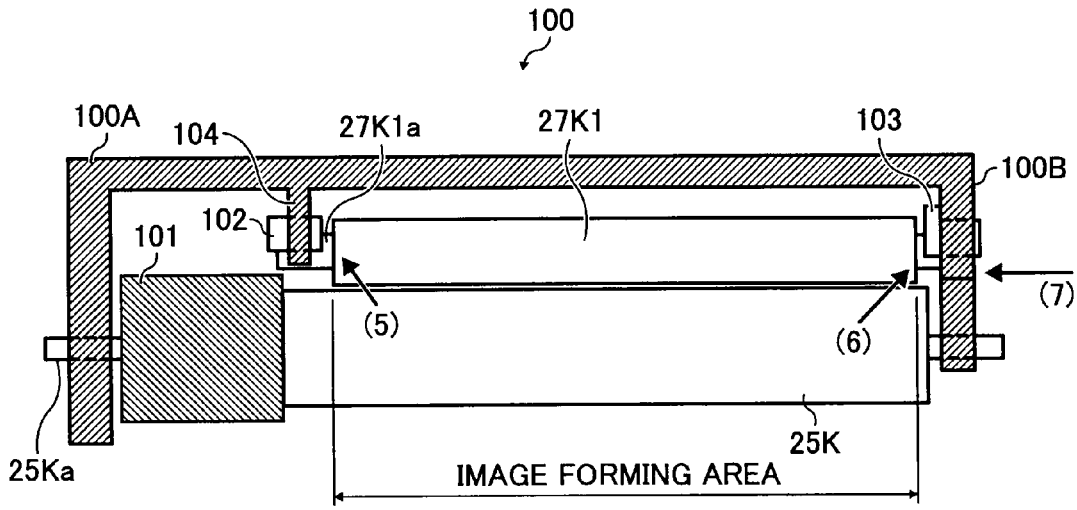
FIG. 2 is a schematic drawing for explaining the configuration of the process cartridge for use in the image forming apparatus according to the present invention.

FIG. 2 is a schematic drawing for explaining the configuration of the process cartridge for use in the image forming apparatus according to the present invention.

Here, an image forming unit for black images is explained as an example. As shown in FIG. 2, the process cartridge 100 disposed at an image forming position has accommodated therein the photosensitive drum 25K and a charging roller 27K1 facing the photosensitive drum 25K.

The process cartridge 100 has side walls 100A and 100B of the casing that are provided on both ends of the photosensitive drum 25K in axial directions parallel to each other so as to a space capable of accommodating therein the members explained above.

The charging roller 27K1 is a roller formed with conductive rubber around the outer perimeter surface of a metal rotating shaft 27K1*a*, and is a member using a contact charging scheme in which the surface of the conductive rubber is made contact with the surface of the photosensitive drum 25K to uniformly charge the surface of the photosensitive member.

On the other hand, the photosensitive drum 25K includes a rotating shaft 25K*a* horizontally provided between the side walls of the casing of the process cartridge 100, and has both ends in an axial direction supported by the side walls of the casing. On one side of the photosensitive drum 25K in an axial direction, a gear-added flange 101 as an emplacing member is disposed that defines the photosensitive drum 25K at a fixed position between the inner surface of a side wall of the casing and an end face on one side of the photosensitive drum 25K in an axial direction.

The gear-added flange 101 is integrally formed with the end face on one side of the photosensitive drum 25K in an axial direction, and defines the length to the inner surface of the side wall of the casing, thereby regulating the position of the photosensitive drum 25K in a thrust direction. Also, by using its installation space, the gear-added flange 101 has an outer perimeter surface with a gear formed thereon for use as a unit of transmitting a driving force of the photosensitive drum 25K. Thus, the gear-added flange 101 also serves as a unit for a function different from a function of positioning the photosensitive drum 25K in a thrust direction.

The rotating shaft 27K1*a* of the charging roller 27K1 has one side in an axial direction, that is, an end on a side corresponding to the gear-added flange 101 on the photosensitive drum 25K side, being rotatably supported by a first bearing member 102, and the other side in the axial direction being rotatably supported by a second bearing member 103.

Figure 3:
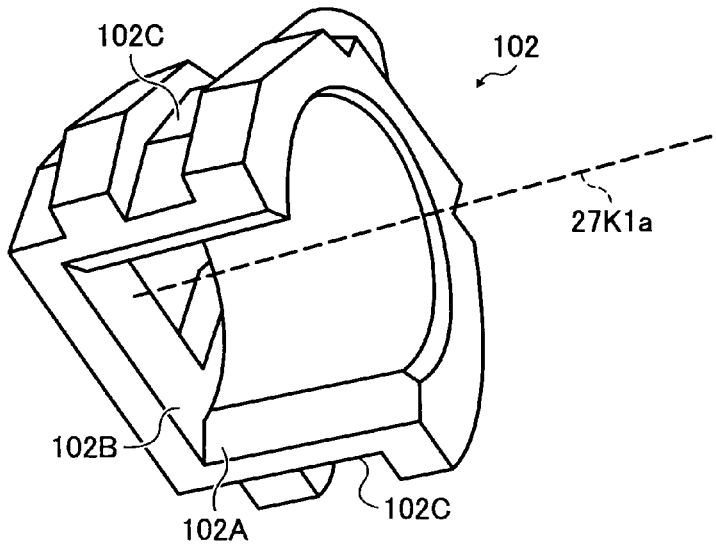
FIG. 3 is a perspective view of one of bearing members for a charging roller for use in the process cartridge according to the present invention.
Figure 4:
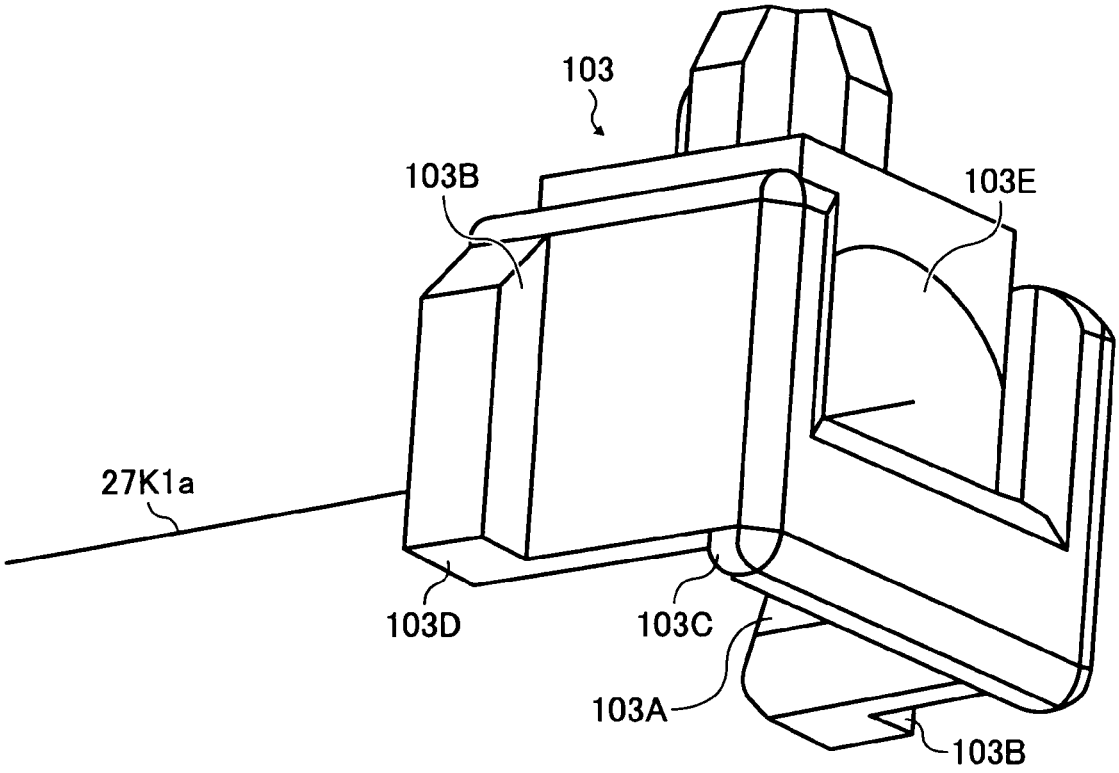
FIG. 4 is a perspective view of the other one of the bearing members for the charging roller for use in the process cartridge according to the present invention.

FIG. 3 is a perspective view of one of the bearing members for a charging roller for use in the process cartridge according to the present invention. FIG. 4 is a perspective view of the other one of bearing members for the charging roller for use in the process cartridge according to the present invention. The first bearing member 102 and the second bearing member 103 are shown in detail in FIGS. 3 and 4, respectively.

The first bearing member 102 has an opening 102A in which the rotating shaft 27K1*a* of the charging roller 27K1 fits, the opening 102A being formed on a part of a bearing surface in a circumferential direction. Inside the bearing surface, a wall portion 102B is provided on which a shaft end of the rotating shaft 27K1*a* can abut in a facing manner. Here, in FIG. 3, a one-dot-chain line with a reference numeral 27K1*a* represents the position of the rotation axis of the charging roller 27K.

The first bearing member 102 has a groove portion 102C formed on its outer perimeter surface. With the groove portion 102C fitting in a supporting portion 104, which will be explained further below, as catching an inner edge of a supporting hole, the first bearing member 102 is held in a state where the movement in a thrust direction is regulated.

The first bearing member 102 is held by the supporting portion denoted by the reference number 104 in FIG. 2 provided on a side facing the gear-added flange 101 of the photosensitive drum 25K between the side walls of the casing.

Figure 5:
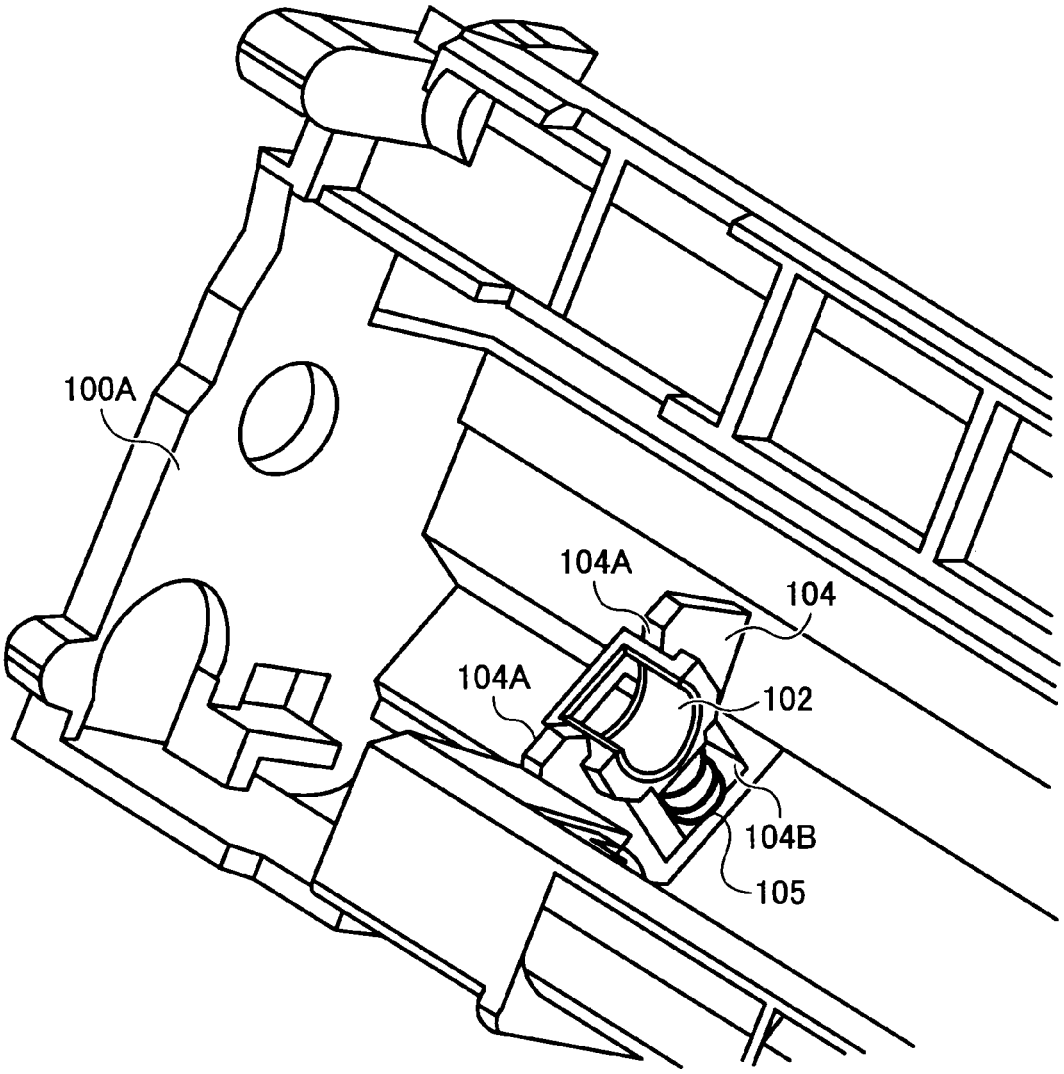
FIG. 5 is a view from a direction of an arrow denoted by a reference numeral 5.

FIG. 5 is a view from a direction of an arrow denoted by a reference numeral 5. In FIG. 5 depicting the state viewed from the direction of the arrow denoted by the reference numeral 5 in FIG. 2, the supporting portion 104 has the supporting hole with a space in which the groove portion 102C provided in the first bearing member 102 can fits from the photosensitive drum 25K side.

A part of the supporting hole of the supporting portion 104, that is, both sides of the opening on a side in which the first bearing member 102 fits, is provided with nail portions 104A engageable with an opening edge of the first bearing member 102. The nail portions 104A are extended portions of a portion that fits in the groove portion of the first bearing member 102. With the end faces of the extended portions mounting on the side end surface of the opening of the first bearing member 102, the first bearing member 102 can be prevented from sliding.

In FIG. 5, the first bearing member 102 fits in the supporting hole on the supporting portion 104 side. With a spring 105 loaded in an accommodation space portion 104B formed adjacent to the supporting hole, a moving behavior to the photosensitive drum 25K side is provided. With this behavior, the abutting state between the photosensitive drum 25K and the charging roller 27K can be constantly maintained.

On the other hand, as shown in FIG. 2, unlike the first bearing member 102, the second bearing member 103 is directly supported by the side wall 100B of the casing without using a member such as the supporting portion 104.

In FIG. 4, the second bearing member 103 has formed on part of the bearing surface in a circumferential direction an opening 103A for causing the rotating shaft 27K1*a* of the charging roller 27K to fits in, and is provided at its ends in an axial direction flange-shaped ribs 103B that can bump onto an inner surface of the side wall 100B of the casing when the outer perimeter surface fits in the supporting hole formed on the side wall 100B of the casing.

Also, a wall surface 103C that regulates a longitudinal direction of the charging roller is formed so as to protrude from a wall surface 103D rotatably and pivotally supporting the charging roller. Until the charging roller is mounted inside the casing, the charging-roller bearing (second bearing member) 103 serves as a function of preventing falling-off inside the casing.

Figure 6:
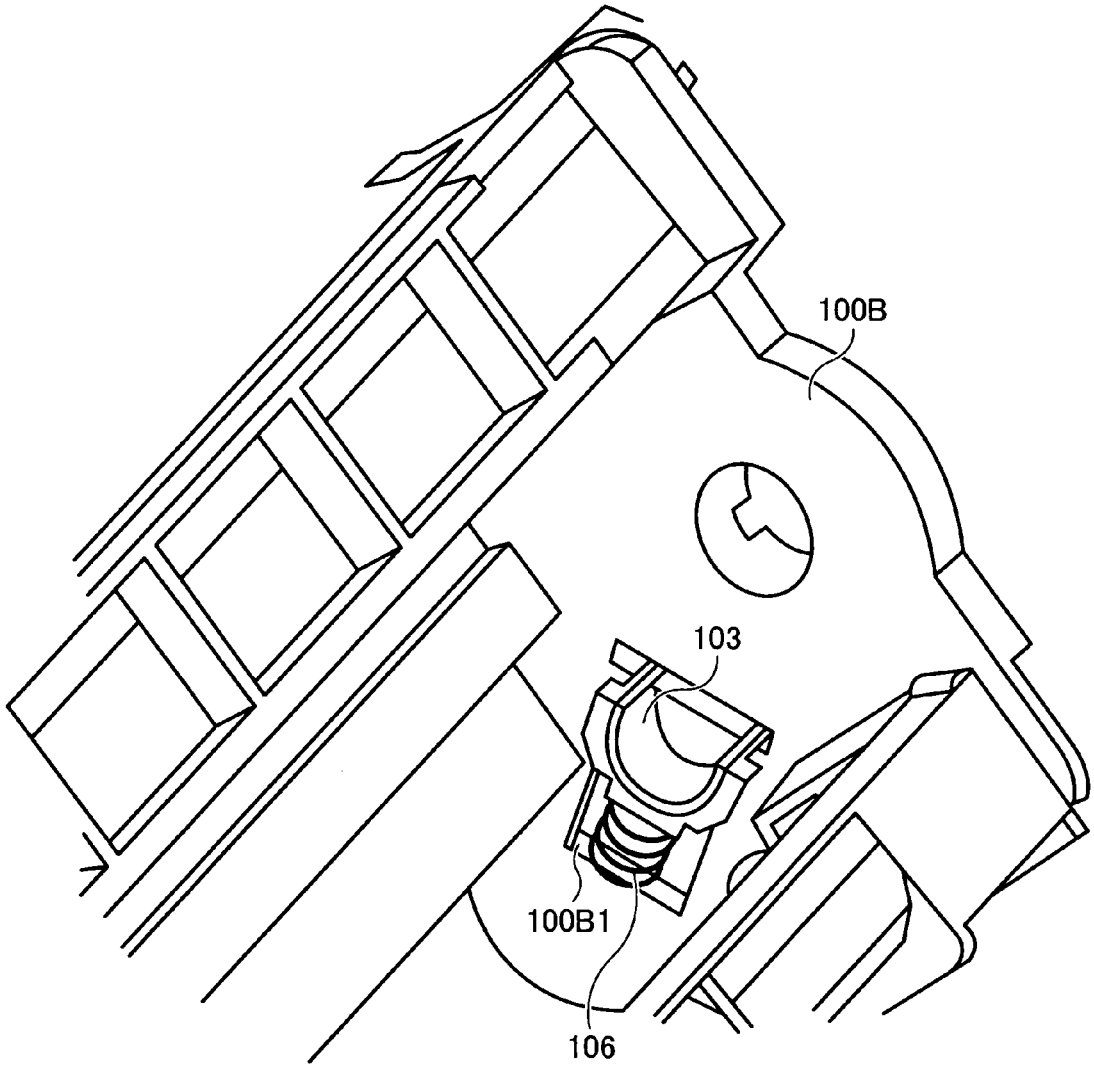
FIG. 6 is a view from a direction of an arrow denoted by a reference numeral 6.

FIG. 6 is a view from a direction of an arrow denoted by a reference numeral 6 in FIG. 2, depicting a fit-in state of the second bearing member 103. In that drawing, when the second bearing member 103 fits in the supporting hole of the side wall 100B of the casing, the ribs 103B bumps on the inner surface of the side wall of the casing to prevent falling-off. Also, similarly to the first bearing member 102, with a spring 106 loaded in an accommodation space 100B1 formed on the side wall 100B of the casing, a moving behavior to the photosensitive drum 25K is provided.

Figure 7:
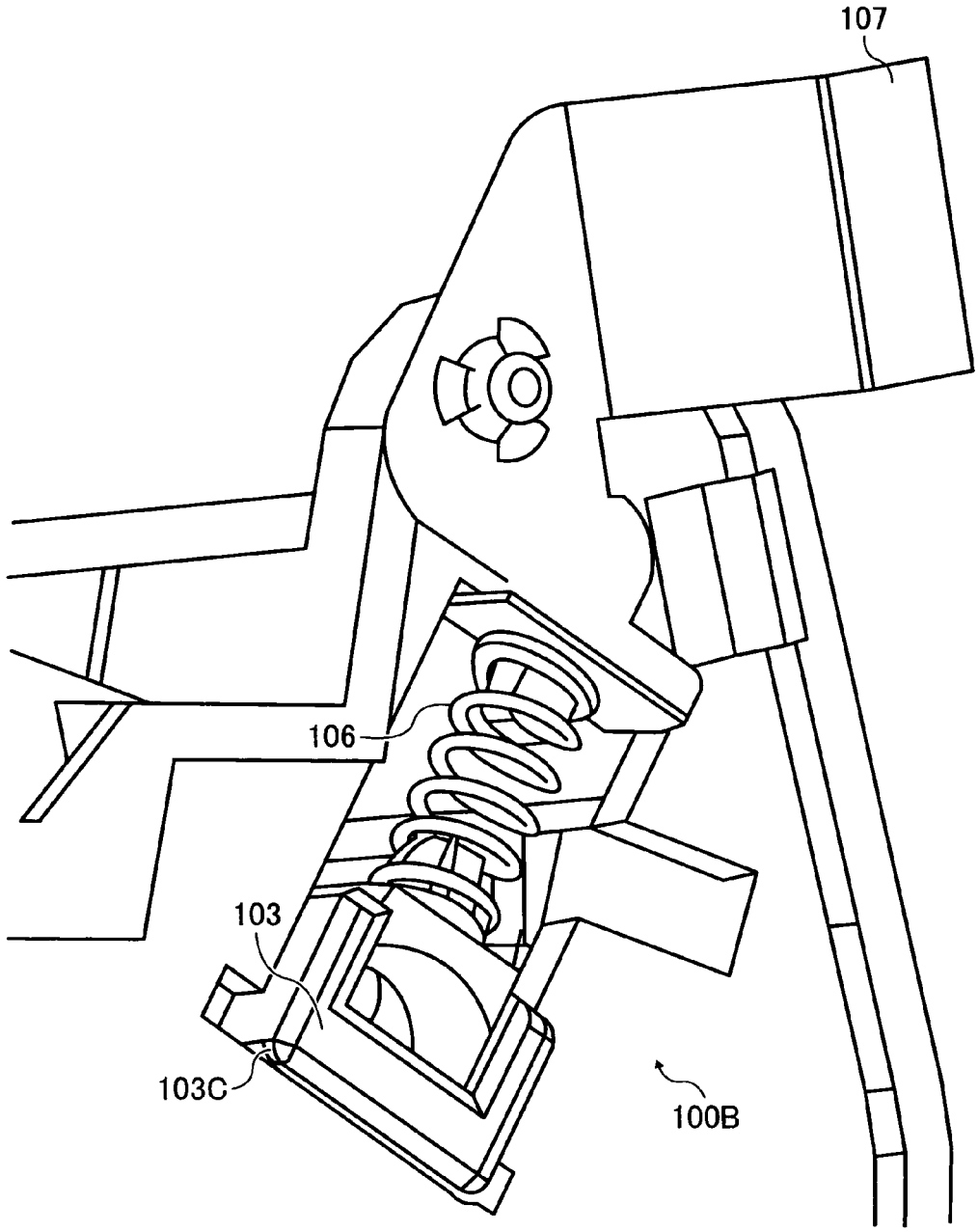
FIG. 7 is a view from a direction of an arrow denoted by a reference numeral 7.

FIG. 7 is a view from a direction of an arrow denoted by a reference numeral 7 in FIG. 2, depicting the second bearing member 103 directly held by the side wall 100B of the casing viewed from the outside of the side wall 100B. Here, even when the wall surface 103C of the second bearing member 103 that regulates the charging roller in the longitudinal direction bumps on the side wall 100B with a pressing force of the spring 106 to make contact with the second bearing member 103 from outside the casing, the second bearing member does not fall-off in the casing.

Figure 8:
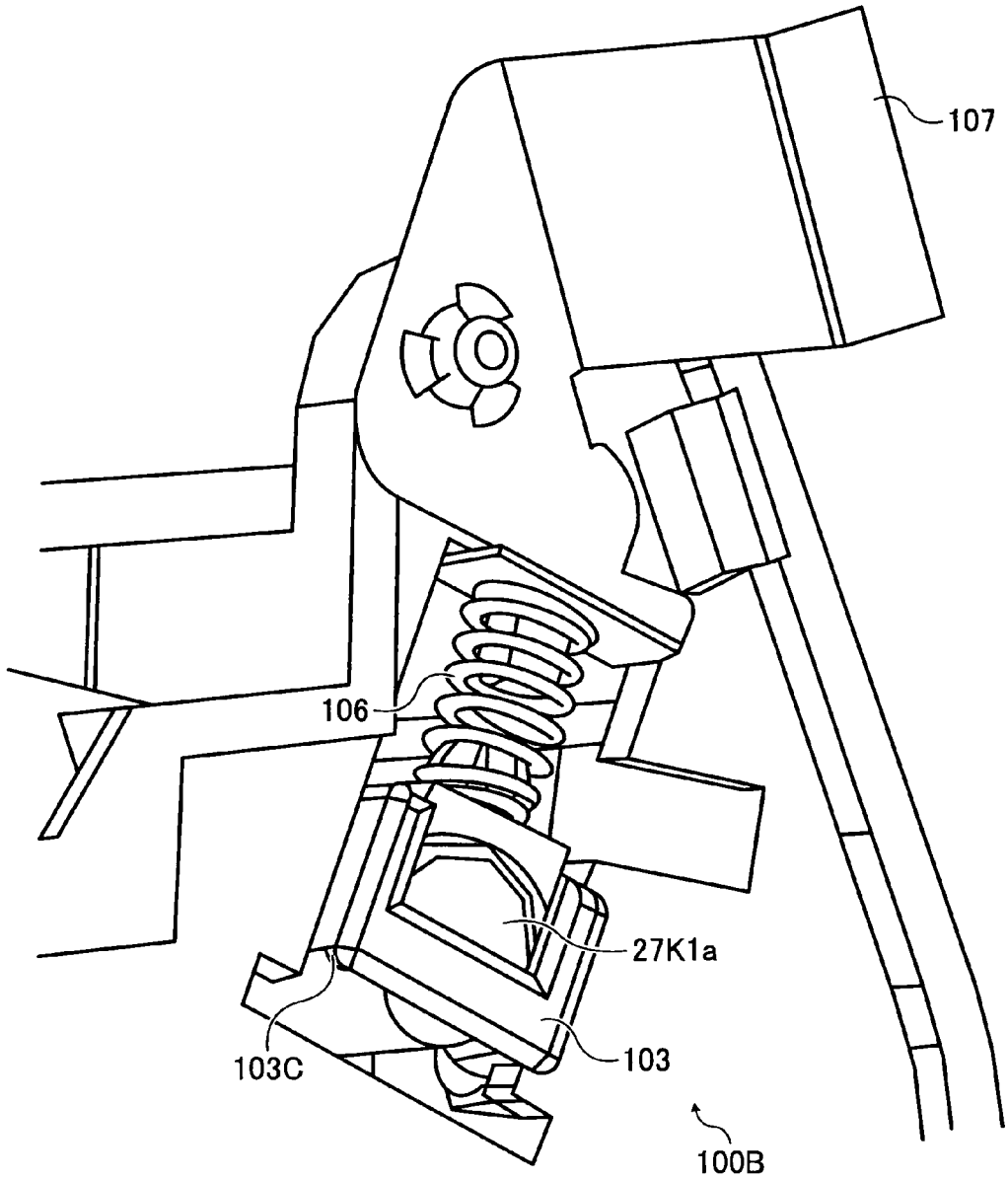
FIG. 8 is a view from a direction of the arrow 7 in a state where the charging roller is mounted.

FIG. 8 depicts a state in which the charging roller 27K is mounted after the state of FIG. 7. The charging roller 27K surpasses the pressing force of the sprint 106 by being the pressed by the photosensitive drum 25, thereby causing the wall surface 103C that regulates the charging roller of the second bearing member 103 to be suspended from the side wall 100B.

For the charging roller 27K with both ends of the rotating shaft 27K1*a* in the axial direction being supported by the first bearing member 102 and the second bearing member 103, the first bearing member 102 is positioned on a perimeter surface side of the photosensitive drum 25K from a position facing the gear-added flange 101 in the axial direction of the photosensitive drum 25K. With this, a space occupied by the charging roller 27K is moved to one of the side wall sides of the casing, that is, the side wall 100B side, within a range in which the image forming area is covered in the axial direction of the photosensitive drum 25K. Thus, the space occupied by the charging roller 27K in the process cartridge 100 in the axial direction can be reduced.

Since the configuration of the present embodiment is as such, when the charging roller 27K is mounted on the process cartridge 100, the second bearing member 103 with its one end in the axial direction of the rotating shaft 27K1*a* of the charging roller 27K being inserted therein is caused to fit in one of the side walls of the casing, that is, the side wall 100B, and then the first bearing member 102 is caused to fit in the supporting portion 104 positioned between the side walls of the casing. At this time, the first bearing member 102 is prevented by the nail portions 104A provided to the supporting portion 104 from being slipped, and is held in a state where the movement in a thrust direction is regulated via the groove portion 102C. Thus, the rotating shaft 25K*a* fits in the opening 102A from the photosensitive drum 25K side.

In this configuration, the rotating shaft 27K1*a* of the charging roller 27K1 is supported only at its one end in the axial direction by using the supporting portion 104 positioned between the side walls of the casing. Therefore, compared with the case where supporting members targeted for both ends in the axial direction are used, for example, one of those supporting members is not present, thereby saving the installation space between the side walls of the casing.

Next, an example of modification of main portions according to the present embodiment is explained.

Since the charging roller 27K is a charging member, a power-supply mechanism is required. For this reason, in the present example, a power-supply contact is provided at a supporting position on the rotating shaft 27K1*a* of the charging roller 27K on the side of the side wall 100B of the casing.

In FIG. 8, the second bearing member 103 is made of a conductive member. Also, the spring 106 providing a correction of directing and moving the second bearing member 103 to the photosensitive drum 25K side is made of a conductive member. With the spring 106, a power-supply contact 107 connected to wiring not shown is made contact. In another configuration, the power-supply contact may directly make contact with a shaft end of the rotating shaft 27K1*a* of the charging roller 27K instead of the spring 106. In this case, as depicted by a reference numeral 103E in FIG. 4, a groove portion for loading the power-supply contact is formed on a wall portion side of the second bearing member 103 on which the shaft end of the rotating shaft abuts in a facing manner, and the power-supply contact is fixedly held in the groove portion 103E.

Figure 9:
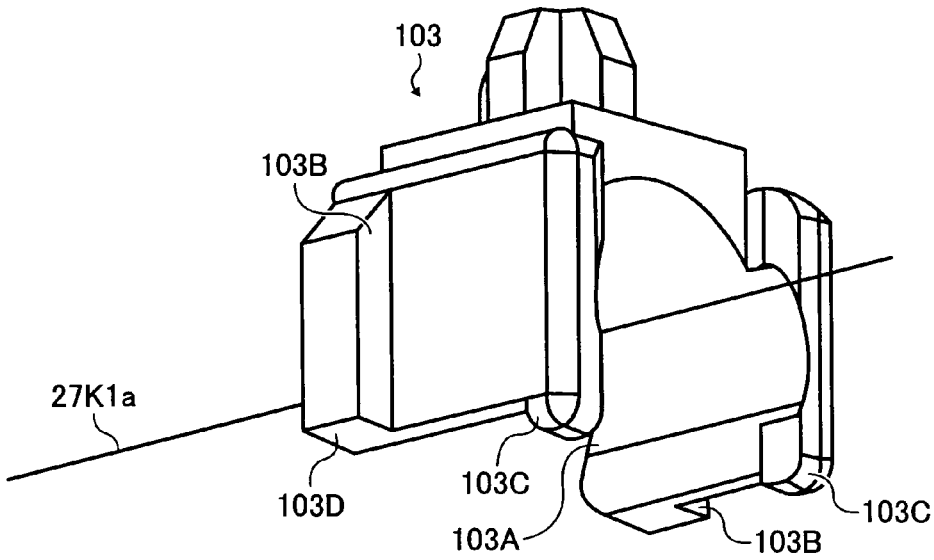
FIG. 9 is a perspective view for explaining another embodiment of the bearing member of the charging roller for use in the process cartridge according to the present invention.

FIG. 9 is a perspective view for explaining another embodiment of the bearing member of the charging roller for use in the process cartridge according to the present invention. As shown in FIG. 9, most of the wall surface 103C that regulates the charging roller in the longitudinal direction may be cut out. Here, the portion 103C protruding from both ends abuts on the side wall 100B of the casing in FIG. 7, thereby preventing falling-off in the casing.

In the present embodiment, the side wall 100B of the casing can be used as a power-supplying unit. Therefore, wiring to the supporting portion 104 positioned in a narrow space between the side walls of the casing is not required, thereby simplifying a wiring operation on the charging roller 27K and maintenance workability.

Next, another embodiment of the present invention is explained.

The present embodiment is characterized in disposition relation of the side wall portion with respect to the bearing members.

That is, as shown in FIG. 2, the supporting portion 104 holding the first bearing member 102 is provided between the side walls 100A and 100B of the casing. When the supporting portion 104 is provided, an anti-slip configuration in a thrust direction of the first bearing member 102 with the nail portion provided to the supporting portion 104 is required. The present embodiment is characterized in that such a special anti-slip configuration is not required, and a configuration for achieving the present embodiment is shown in FIG. 10.

Figure 10:
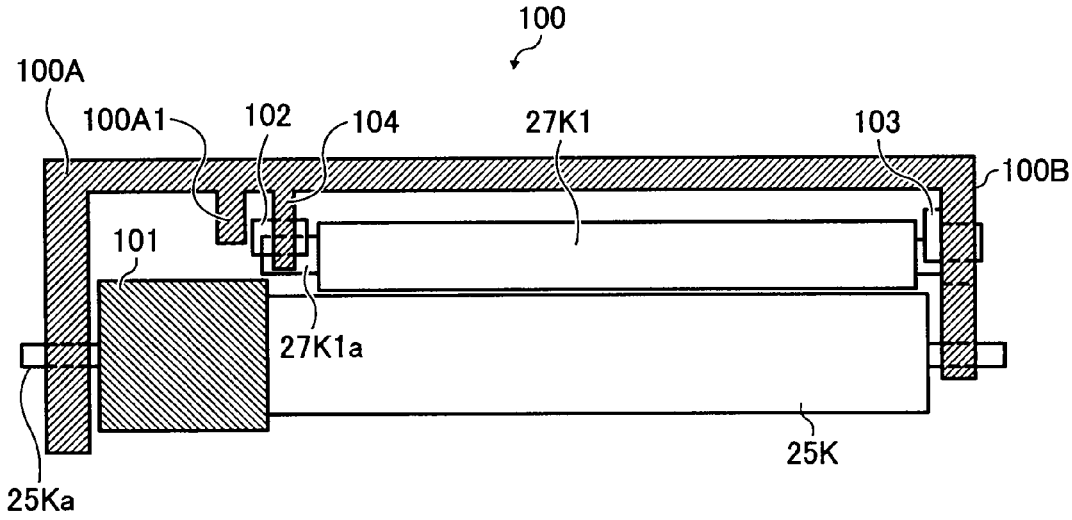
FIG. 10 is a schematic drawing for explaining another embodiment of the present invention.

FIG. 10 is a schematic drawing for explaining the other embodiment of the present invention. In FIG. 10, outside the supporting portion 104 by which a first bearing member 102 is supported in an axial direction of the charging roller 27K, a side wall 100A1 is provided at a position adjacent to the supporting portion 104. With this, the movement of the first bearing member 102 in a thrust direction can be easily regulated.

In the foregoing configuration, while the movement to the outside of the first bearing member 102 is regulated by the side wall 10A, the movement to the inside of the first bearing member 102 is regulated by the ribs 103B (refer to FIG. 4) of the second bearing member 103. Therefore, the movement of the charging roller 27K in a thrust direction is inhibited, thereby accurately maintaining the position facing the image forming area of the photosensitive drum 25K. Furthermore, even with an impact in a thrust direction, the movement in that direction is regulated, thereby preventing an accidental damage and the like.

With this mechanism, assembling accuracy can be improved.

The present invention allows provision of a charging roller bearing member, process cartridge, and image forming apparatus capable of downsizing and improving component assembly capability and maintenance workability.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A charging-roller bearing member for an image forming apparatus including an image carrier drum rotatably supported by side walls of a casing in such a manner that a perimeter surface of the image carrier drum is rotatable and a charging unit that uniformly charges the perimeter surface of the image carrier drum in the same casing, wherein the charging unit is a charging roller, and the charging-roller bearing member comprises:

a first bearing member fitting in a first side of a rotating shaft of the charging roller in an axial direction; and a second bearing member fitting in a second side of the rotating shaft in the axial direction, wherein the first bearing member and the second bearing member are arranged opposite to each other along a rotating direction of the perimeter surface of the image carrier drum, the first bearing member is held by a supporting portion provided in the casing on a side corresponding to an emplacing member of the image carrier drum, the second bearing member is held by fitting in a fit-in portion from inside, the fit-in portion being formed on an exterior side wall of the casing on a side in a longitudinal direction of the image carrier drum where the emplacing member is not positioned, and a first wall surface that regulates the charging roller in a longitudinal direction is formed on the second bearing member in a protruding manner from a second wall surface rotatably and pivotally supporting the charging roller.

2. The charging-roller bearing member according to claim 1, wherein in a state where the charging roller is not mounted inside the casing, under a pressing force of a spring member, the first wall surface bumps on the casing with the second wall surface bumping on the casing, and in a state where the charging roller is mounted inside the casing, the first wall surface bumps on the charging roller without bumping on the casing.

3. The charging-roller bearing member according to claim 1, wherein the charging-roller bearing member is formed of a conductive resin.

4. An image forming apparatus comprising the charging-roller bearing member according to claim 1.

5. A process cartridge comprising:

a charging-roller bearing member, wherein the charging-roller bearing member is for an image forming apparatus including an image carrier drum rotatably supported by side walls of a casing in such a manner that a perimeter surface of the image carrier drum is rotatable and a charging unit that uniformly charges the perimeter surface of the image carrier drum in the same casing, the charging unit is a charging roller, and the charging-roller bearing member comprises:

a first bearing member fitting in a first side of a rotating shaft of the charging roller in an axial direction; and a second bearing member fitting in a second side of the rotating shaft in the axial direction, wherein the first bearing member and the second bearing member are arranged opposite to each other along a rotating direction of the perimeter surface of the image carrier drum, the first bearing member is held by a supporting portion provided in the casing on a side corresponding to an emplacing member of the image carrier drum, the second bearing member is held by fitting in a fit-in portion from inside, the fit-in portion being formed on an exterior side wall of the casing on a side in a longitudinal direction of the image carrier drum where the emplacing member is not positioned, and a first wall surface that regulates the charging roller in a longitudinal direction is formed on the second bearing member in a protruding manner from a second wall surface rotatably and pivotally supporting the charging roller.

6. The process cartridge according to claim 5, wherein the emplacing member is formed with a gear-added flange including a gear capable of abutting on an end face on one side in the longitudinal direction of the image carrier drum and being provided on an outer perimeter surface.

7. The process cartridge according to claim 5, wherein the charging roller includes a power-supply contact that is arranged at a fitting portion on a side wall of the casing where the second bearing member is held.

8. The process cartridge according to claim 5, wherein one end of the charging roller including the first bearing member in an axial direction is positioned on an image carrier drum side position corresponding to the emplacing member in a longitudinal direction of the image carrier drum.

9. The process cartridge according to claim 5, wherein the first bearing member includes an opening on a side facing the image carrier drum.

10. The process cartridge according to claim 5, wherein a side wall portion of the casing is provided outside of the supporting portion that holds the first bearing member.

11. The process cartridge according to claim 5, wherein the side wall portion of the casing is provided adjacent to an outer end face of the first bearing member.

12. The process cartridge according to claim 5, wherein the first bearing member is provided so as not to slip from the supporting portion, and is insertable from a side of the image carrier drum into the supporting portion.

13. An image forming apparatus comprising the process cartridge according to claim 5.

14. The image forming apparatus according to claim 13, wherein the process cartridge is provided for each of image forming units forming a color image.

* * * * *